US008558462B2

(12) United States Patent
Chen

(10) Patent No.: US 8,558,462 B2
(45) Date of Patent: Oct. 15, 2013

(54) DRIVING CIRCUIT FOR CASCADE LIGHT EMITTING DIODES

(75) Inventor: Te-Cheng Chen, Hsinchu County (TW)

(73) Assignee: Numen Technology, Inc., Jhubei (TW)

( * ) Notice: Subject to any disclaimer, the term of this patent is extended or adjusted under 35 U.S.C. 154(b) by 202 days.

(21) Appl. No.: 13/165,786

(22) Filed: Jun. 21, 2011

(65) Prior Publication Data

US 2012/0104952 A1 May 3, 2012

(30) Foreign Application Priority Data

Oct. 29, 2010 (TW) ..... 99137185 A

(51) Int. Cl.
*H05B 37/02* (2006.01)

(52) U.S. Cl.
USPC ..... 315/122; 315/119; 315/185 R; 315/291; 315/294; 315/308

(58) Field of Classification Search
USPC ..... 315/119, 121, 122, 125, 185 R, 192, 315/224, 291, 294, 307, 308
See application file for complete search history.

(56) References Cited

U.S. PATENT DOCUMENTS

| | | | | |
|---|---|---|---|---|
| 7,518,525 | B2 * | 4/2009 | Chou | 340/815.45 |
| 2008/0094000 | A1 * | 4/2008 | Yamamoto et al. | 315/250 |
| 2009/0230883 | A1 * | 9/2009 | Haug | 315/297 |
| 2010/0134018 | A1 * | 6/2010 | Tziony et al. | 315/122 |
| 2011/0068701 | A1 * | 3/2011 | van de Ven et al. | 315/185 R |
| 2011/0115405 | A1 * | 5/2011 | Guo et al. | 315/294 |

* cited by examiner

*Primary Examiner* — Douglas W Owens
*Assistant Examiner* — Thai Pham
(74) *Attorney, Agent, or Firm* — Alan Kamrath; Kamrath IP Lawfirm, P.A.

(57) ABSTRACT

The driving circuit includes a power module, a plurality of LED modules, and a constant current component. Each LED module includes a bypass circuit and at least one light emitting diode. The light emitting diode is serially connected between a first end and a second end of the bypass circuit. The first end of each bypass circuit is coupled to the power module or a third end of an adjacent upstream bypass circuit for serially connecting the constant current component electrically, thereby achieving the illumination of different total numbers of LED units in accordance with various voltage changes, and cascade light emitting diodes having increased power efficiency.

8 Claims, 6 Drawing Sheets

DRIVING CIRCUIT FOR CASCADE LIGHT EMITTING DIODES

BACKGROUND OF THE INVENTION

1. Field of the Invention

The present invention relates to a driving circuit for a plurality of cascade light emitting diodes, and more particularly, relates to a driving circuit having different total number of LED units which can be illuminated in accordance with various voltage changes, and the driving circuit for the cascade light emitting diodes having increased efficiency.

2. Description of the Prior Art

Referring to FIG. 1, a conventional light emitting diode (LED) driver circuit is illustrated. For reducing circuit sizes and in light of cost saving concerns, some manufacturers have adopted the usage of transistor control circuit in specified voltage interval under conducting state, so as to omit having larger elements, such as, transformer and filter capacitor.

The LED driver circuit 10 has an alternating current power supply 12 with a bridge rectifier comprising a plurality of diodes 141, upon which rectifying is performed to form a direct current power source. In the LED driver circuit, an N-type MOS power transistor 16 is used to control on and off of electric current flow, a first transistor 151 is used to limit the current flow for the light emitting diode 18, and a second transistor 153 is used to control the duration of the electrical current flow.

The drain of the power transistor 16 is coupled to the bridge rectifier 14, the source is coupled to the base of the first transistor 151, and the gate is coupled to the collector of the first transistor 151. The light emitting diode 18 is serially connected between the emitter of the first transistor 151 and the bridge rectifier 14. In addition, a first resistor 171 is connected between the drain and gate of the power transistor 16. The fifth resistor 175 is connected between the base and the emitter of the first transistor 151. The sixth resistor 176 is connected between the collector and the base of the first transistor 151.

The second resistor 172 and the third resistor 173 are serially connected between the drain of the power transistor 16 and the emitter of the first transistor 151. The base of the second transistor 153 is connected to the connection point of the second resistor 172 and the third resistor 173, and the emitter of the second transistor 153 is connected to the emitter of the first transistor 151. The fourth resistor 174 is connected to between the collector of the second transistor 153 and the gate of the power transistor 16. Furthermore, a capacitor 155 is coupled to the two ends of the light emitting diodes 18.

According to the above mentioned device configuration, when the voltage output from the bridge rectifier 14 is slowly increased from zero, the gate voltage of the power transistor 16 is correspondingly increased accordingly. When the voltage difference between the gate and source becomes larger than the threshold voltage, the power transistor 16 starts to conduct, and the current flowing through the fifth resistor 175 starts to increase. When the potential difference of the electrical current flowing through the fifth resistor 175 is larger than the threshold voltage of the first resistor 151, the first resistor 151 starts conducting, and at this moment, the gate voltage of the power transistor 16 is pulled down to a reduced voltage level, thereby reducing the conducting current. The reduction of the conducting current of the power transistor 16 then leads to the reduction of the potential/voltage difference through the fifth resistor 175, thereby causing the degree of conduction of the first transistor 151 to be reduced, and the reduction of the degree of pull down for the gate voltage of the power transistor 16 also occurs. As a result, the conducting current for the power transistor 16 would again increase, thereby mutually restraining and limiting the current flow through the fifth resistor 175, and making it thereof becoming a fixed value.

As the output voltage for the bridge rectifier 14 increases, the current flowing through the second resistor 172 and the third resistor 173 is slowly increased, finally making the second transistor 153 conducting and pulling down the gate voltage of the power transistor 16, thereby turning off the power transistor 16. When the voltage output of the bridge rectifier 14 is slowly reduced from a high voltage level, the current of the third resistor 173 is slowly reduced; when the potential/voltage difference for the current flow through the third resistor 173 is lower than the threshold voltage of the second transistor 153, the second transistor 153 is then turned off. When the gate voltage of the power transistor 16 is increased, the power transistor 16 is thereby allowed to be conducting, and again the driving current is provided to the LED 18. Finally, the output voltage of the bridge rectifier 14 is reduced to zero, and the entire circuit is returned to zero current flow state, and thereby completing one cycle.

Although the aforementioned conventional circuit can achieve objects such as the omission of transformer and/or filter capacitor; however, as seen in the voltage waveform, for the sake of preventing the LED 18 from burning out, the above conventional circuit can only be conducting within a small limited voltage range, whereas in other voltage ranges, it is configured in an off state, thereby leading to excessively low energy utilization rate.

Meanwhile, for improving energy utilization rate, US patent application publication number 20090230883 disclosed a stacked LED controller, in which each LED controller drives one or more LEDs, respectively, and can serially connect a string of LED controllers between a supply voltage source and ground.

When an LED controller detects that its input voltage is below a threshold voltage needed for driving the LED and thus cannot drive an upstream LED controller, a bypass switch is used to bypass an adjacent upstream controller depending on the detected input voltage level. When the input voltage exceeds a threshold needed for driving the LED, all of the normally-on bypass switches are turned off, so that all of the upstream controllers are energized.

The aforementioned LED controller although may improve power usage efficiency, but their corresponding circuitry is relatively complicated, and their manufacturing cost is relatively high, and the voltage without reaching the threshold voltage of the most upstream LED controller can still lead to having some electric power to be wasted.

SUMMARY OF THE INVENTION

An object of present invention is to provide a driving circuit for a plurality of cascade light emitting diodes, in particularly to a driving circuit that illuminate various different total numbers of LED units in accordance with various voltage changes, and the driving circuit for the cascade light emitting diodes having increased efficiency.

Another object of the present invention is to provide a driving circuit for cascade light emitting diodes, in which primarily a bypass circuit is used for connecting light emitting diodes is provided for the cascading LEDs.

Another object of the present invention is to provide a driving circuit for cascade light emitting diodes, in which the bypass circuit can be realized by a voltage regulator.

Another object of the present invention is to provide a driving circuit for cascade light emitting diodes, in which the light emitting diode can be connected between an input terminal and an output terminal of the voltage regulator, and voltage is inputted at the input terminal, and the ground terminal is connected to an adjacent downstream circuit.

Another object of the present, invention is to provide a driving circuit for cascade light emitting diodes, which can adjust the detected resistance by adjusting the rated bypass current value for the bypass circuit (of the constant current).

Another object of the present invention is to provide a driving circuit for cascade light emitting diodes, which has a constant current component for protecting each of the light emitting diodes Another object of the present invention is to provide a driving circuit for cascade light emitting diodes, in which the rated bypass current value for each of the bypass circuit (of the constant current) is lower than the rated current of the constant current component.

Another object of the present invention is to provide a driving circuit for cascade light emitting diodes, in which the power supply can be of unstable direct current or alternating current power supply which requires rectifying.

For achieving the above objects, the present invention provides a driving circuit for cascade light emitting diodes, which includes a power module, for providing a direct current voltage and a ground potential, a plurality of light emitting diodes modules serially connected between the direct current voltage and the ground potential. Each light emitting diode module includes a bypass circuit and a light emitting diode, respectively, in which each bypass circuit includes a first terminal, a second terminal, and a third terminal, respectively. Each light emitting diode is respectively connected to between the first terminal and the second terminal of the corresponding bypass circuit, and the first terminal of each bypass circuit is connected to a direct current voltage or the third terminal of the adjacent upstream bypass circuit, and a constant current component is serially connected between the light emitting diode modules and the power module.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the present disclosure. Moreover, in the drawings like reference numerals designate corresponding parts throughout the several views. Wherever possible, the same reference numerals are used throughout the drawings to refer to the same or like elements of an embodiment.

DETAILED DESCRIPTION OF THE EMBODIMENTS

Figure 1:
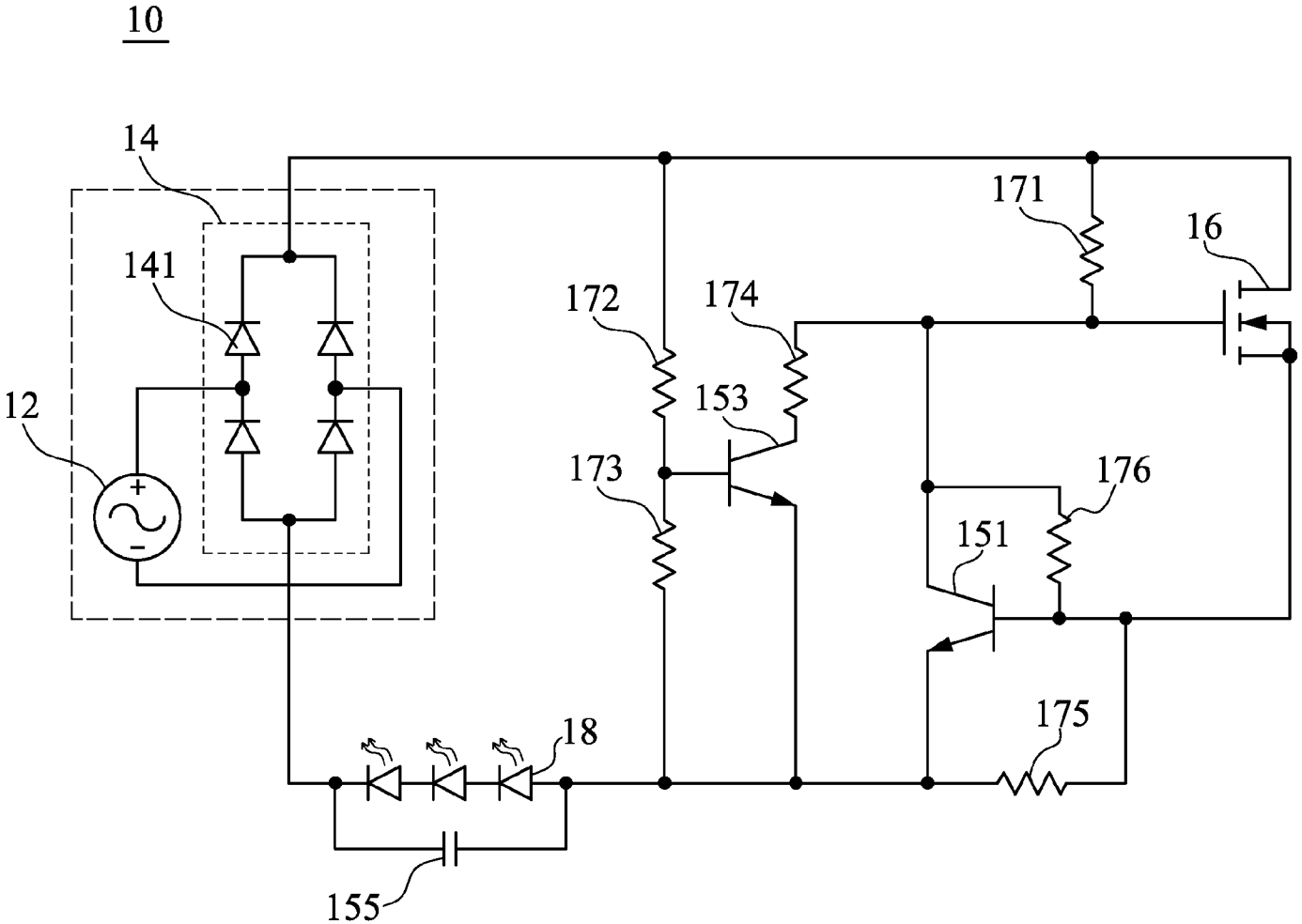
FIG. 1 (Prior art)
FIG. 1 shows a conventional light emitting diode (LED) driver circuit.
Figure 2:
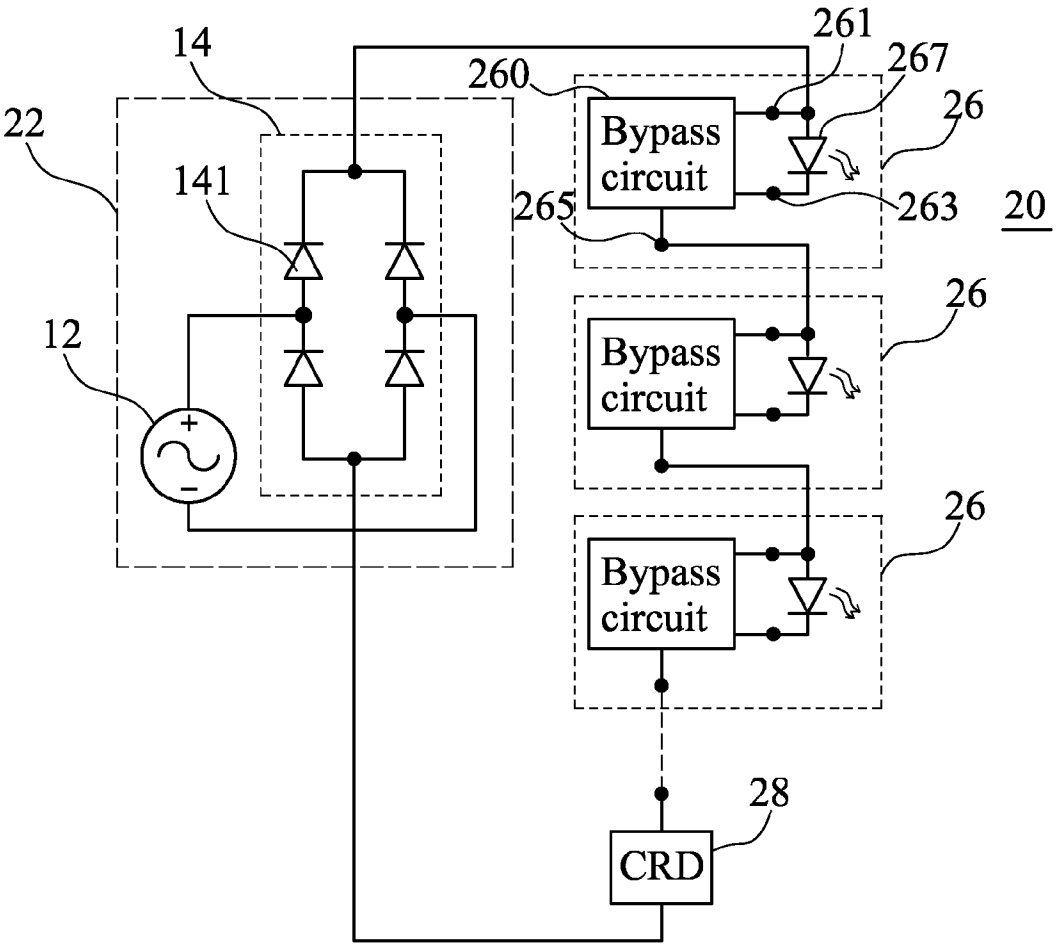
FIG. 2 shows a circuit diagram for a driving circuit for cascade light emitting diodes according to an embodiment of the present invention.

First, FIG. 2 shows a circuit diagram for an embodiment of the present invention. As shown in FIG. 2, the driving circuit for cascade light emitting diodes 20 includes a power module 22, a plurality of LED modules 26, and a constant current component 28.

The power module 22 is to used for providing a direct current voltage and a ground potential, and can also be coupled to an alternating current power supply 221, which is coupled to a rectifying unit 24 to provide power. The rectifying unit 24 is preferably formed by a bridge rectifier made from a plurality of diodes 241.

Each light emitting diode module 26 includes a bypass circuit 260 and a light emitting diode 267. In each light emitting diode module 26, the bypass circuit 260 includes a first terminal 261, a second terminal 263, and a third terminal 265. The light emitting diode 267 is connected between the first terminal 261 and the second terminal 263.

The direct current voltage or the output voltage of the adjacent upstream light emitting diode module 26 is connected to a first terminal 261 of the bypass circuit 260, and the third terminal 265 of the bypass circuit 260 is connected to the first terminal 261 of the bypass circuit 260 of an adjacent downstream light emitting diode module 26, and several light emitting diodes 26 are serially connected to form a cascade circuit.

A current regulative device (CRD) 28 can be connected in between to the power module 22 and the light emitting diode modules 26, or between the light emitting diode modules 26 arranged in cascade manner, for providing the limiting current function, for preventing potential burn out of the light emitting diode 267 due to excessive current flow. The current regulative device 28 can be realized in the form of a current regulative diode (CRD).

Figure 3:
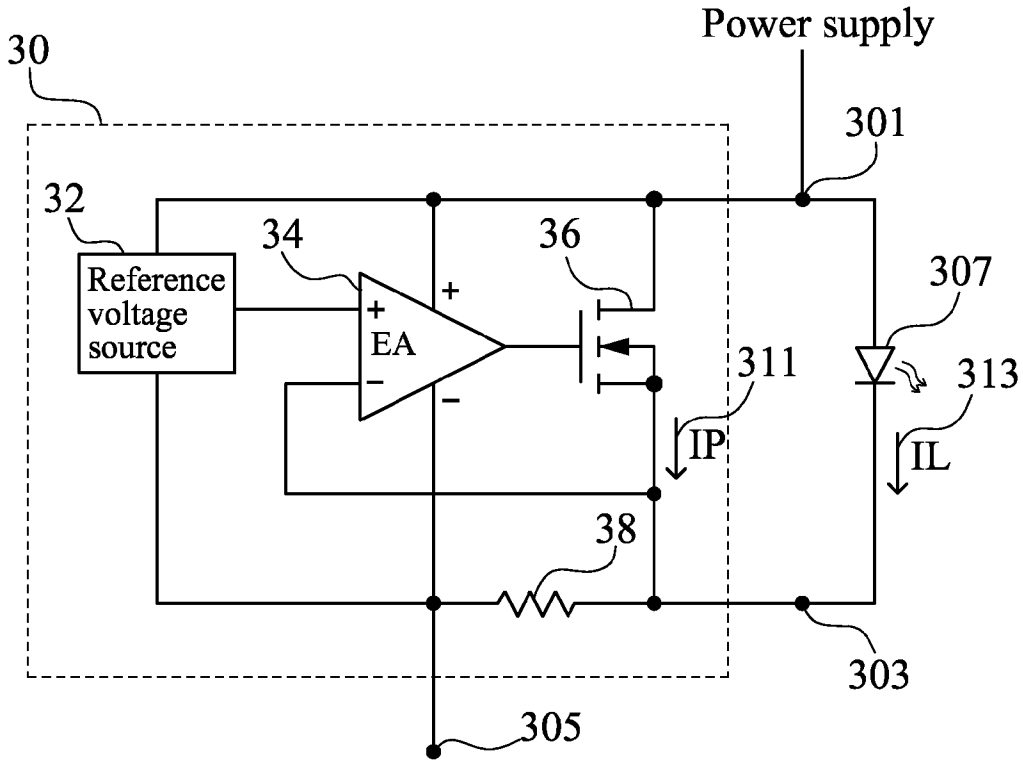
FIG. 3 shows a circuit diagram for a light emitting diode module according to the embodiment of the present invention.

Referring to FIG. 3, a circuit diagram for a light emitting diode module according to the embodiment of the present invention is shown. As shown in FIG. 3, this embodiment shows that, the bypass circuit 30 includes an error amplifier (EA) 34, a reference voltage source 32, a current limiting transistor 36, and a sensing resistor 38.

The reference voltage source 32 is connected to the first terminal 301 and the third terminal 305 of the bypass circuit 30, for generating a reference voltage. The current limiting transistor 36 is connected in between the first terminal 301 and the second terminal 303, for adjusting the bypass current. The positive terminal of the error amplifier 34 is connected to the reference voltage source and receiving the reference voltage, and the negative terminal is connected to the second terminal 303 of the bypass circuit 30. The output terminal of the error amplifier 34 is connected to the gate or the base of the current limiting transistor. The sensing resistor 38 is connected to between the second terminal 303 and the third terminal 305. The light emitting diode 307 is connected to between the first terminal 301 and the second terminal 303.

Assuming if the light emitting diode 307 is to an ideal component, that is, when the supply voltage is below the threshold voltage, no current flows through. When the input voltage of the first terminal 301 is below the threshold voltage of the light emitting diode 307, the light emitting diode 307 is in an open circuit state, and all of the current flowing through the current limiting transistor 36 of the bypass circuit 30 forms a bypass current (IP) 311, and flows through the sensing resistor 38, and from the third terminal 305 to then flow to adjacent downstream light emitting diode module.

When the voltage of the first terminal 301 is above the threshold voltage of the light emitting diode 307, the light emitting diode 307 begins to be conducting, and form a load current (IL) 313. In the present embodiment, when the load current 313 is increased, the bypass current 311 (IP) is thereby reduced. When the load current 313 is larger than or equal to the normal rated bypass current of the bypass circuit 30, the voltage drop produced by the load current 313 which flows through the sensing resistor 38 then completely close or turn off the current limiting transistor 36 by the error amplifier 34, and all of the current flowing from the light emitting diode 307 and the sensing resistor 38 is to flow through the third terminal 305 to an adjacent downstream light emitting diode module.

The light emitting diode 307 when providing a voltage up to a level below that of the threshold voltage, would already have started conducting, and allowing the current to flow. In this embodiment, the creation or generating of the load current 313 leads to the bypass current 311 passing though the limiting current transistor 36 to be reduced, to the extent of completely closing or turning off of the current limiting transistor 36, thus allowing no scenario for wasting electric energy to have occurred.

When the current limiting transistor 36 of the voltage stabilizer 30 is completely turned off or closed, the load current 313 can be increased due to the increased rising of the voltage of the input terminal, the first terminal 301 thus prevents the light emitting diode 307 from burning out, and one would require to dispose a constant current component 28 therein.

The bypass circuit 30 can be integrated in a single circuit chip, for allowing subsequent processing.

Figure 4:
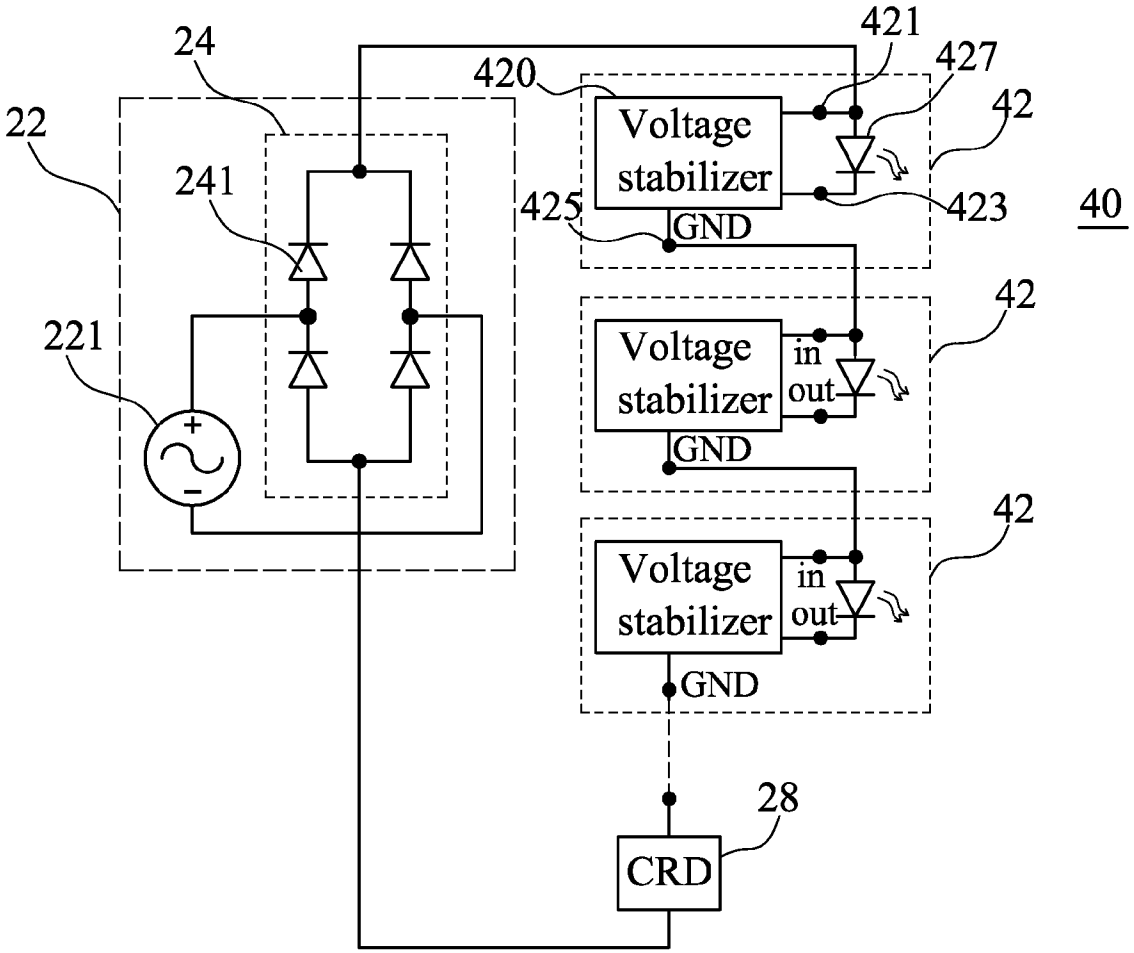
FIG. 4 shows a circuit diagram for a driving circuit for cascade light emitting diodes according to another embodiment of the present invention.

Referring to FIG. 4, a circuit diagram for another embodiment is shown. The structure for the driving circuit for the cascade light emitting diodes 40 according to this embodiment is substantially the same as the embodiment shown in FIG. 2, with the difference being that the present embodiment uses the voltage stabilizer 420 in combination with the light emitting diode 427 to form the light emitting diode module 42.

The input terminal 421 of the voltage stabilizer 420 corresponds to the first terminal of the bypass circuit, the output terminal 423 of the voltage stabilizer 420 corresponds to the second terminal of the bypass circuit, and a ground terminal 425 of the voltage stabilizer 420 corresponds to the third terminal of the bypass circuit.

Because the voltage stabilizer 420 has similar circuit construction as the bypass circuit of the embodiments of present invention, therefore, by adopting the aforementioned layout/arrangement method, the bypass function of present invention is thereby realized.

In the light emitting diode module 42 of the present invention, the voltage stabilizer 420 can be preferably be a low dropout regulator (LDO).

Figure 5:
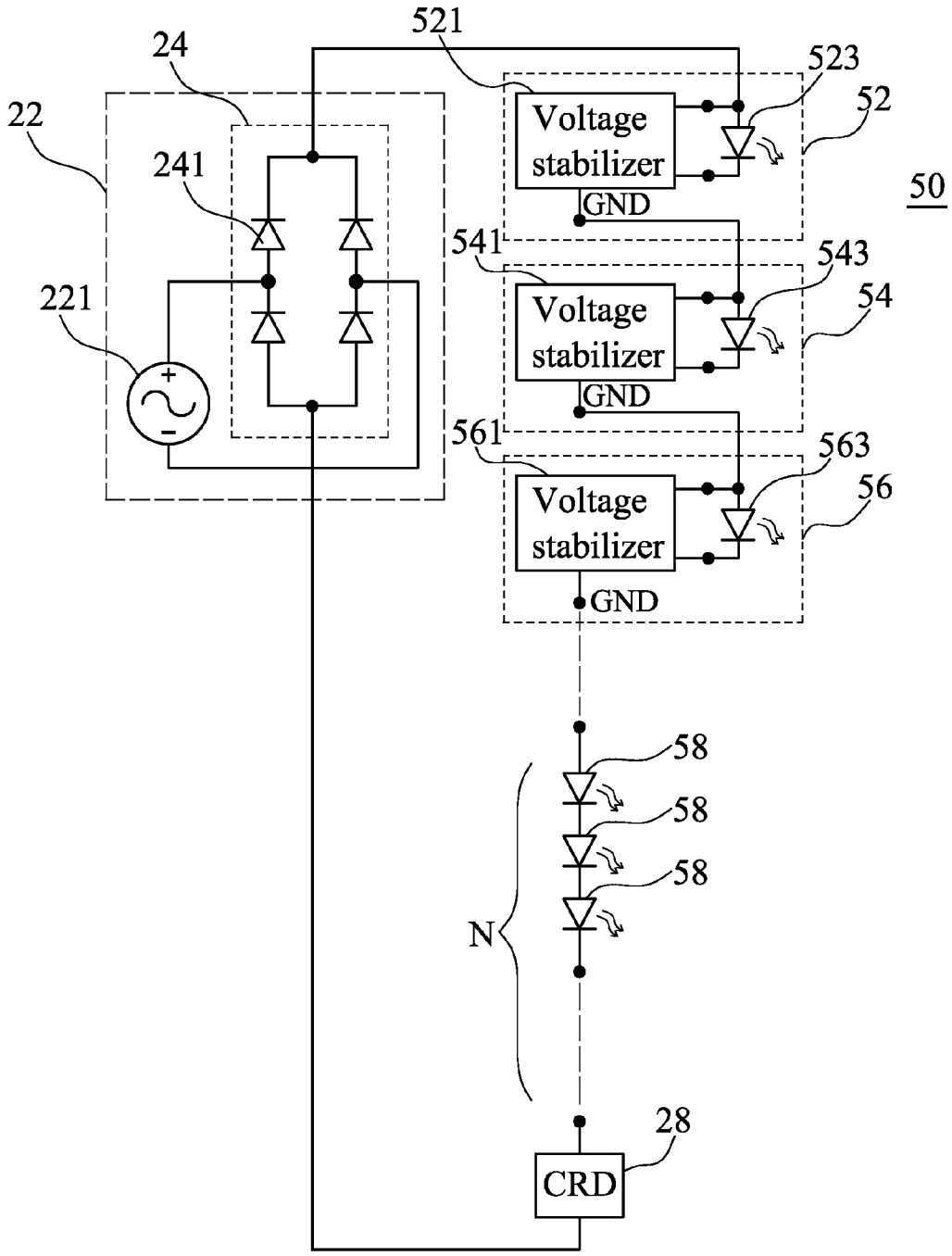
FIG. 5 shows a circuit diagram for a driving circuit for cascade light emitting diodes according to yet another embodiment of the present invention.

Referring to FIG. 5, a circuit diagram for yet another embodiment is shown. This embodiment is substantially the same as the embodiment shown in FIG. 2, with a difference being that, in the driving circuit for the cascade light emitting diodes 50 in the present embodiment, the bypass circuit 521, 541, 561 for each light emitting diode module 52, 54, 56 can have rated bypass current value having minor differences in values.

If the rated bypass current value of the bypass circuit 541 is the largest, followed by that of the bypass circuit 561, and the bypass circuit 521 being the lowest, when the direct current voltage is risen from zero volts as outputted from the power module 22, because the rated bypass current value is the lowest, thus the load current through the light emitting diode 523 would at a very early stage completely close or turn off the limiting current transistor of the bypass circuit 521, thereby allowing current to flow through the light emitting diode 523. Relatively speaking, the light emitting diode 523 is illuminated first, followed by the light emitting diode 563, and finally the light emitting diode 543 is illuminated. Thus, the appropriate arrangement of the output voltage of the bypass circuit 521, 541, 561 of the light emitting diode module 52, 54, 56, the order or sequence for the illumination of each of the respective light emitting diode 523, 543, 563 can be controlled.

The driving circuit for the cascade light emitting diodes 50 can be directly serially connected to more than one light emitting diodes 58. Using this configuration, as the direct current voltage outputted from the power module 22 is increased from zero, the light emitting diode 58 which is disposed directly adjacent would first be illuminated, and the duration for illumination would also be longest, thus it can be used for central illumination for the lamp. Prior to the direct current voltage being above the voltage drop caused by the more than one light emitting diodes 58, the current is flowed through the current limiting transistor of the bypass circuit 521, 541, 561 of each of the light emitting diode module 52, 54, 56, and each light emitting diode 523, 543, 563 would not be illuminated. Upon the direct current voltage that is outputted from the power module 22 being higher than the voltage drop of the more than one light emitting diodes 48, the persistent increasing voltage would sequentially or orderly illuminate the light emitting diode 523, 563, 543 for each of the light emitting diode modules 52, 56, 54.

When the direct current voltage that is outputted from the power module 22 is lowered from a high voltage level to zero, each of the light emitting diode would be turned off or lighting-off in reverse sequence from those described above.

Figure 6:
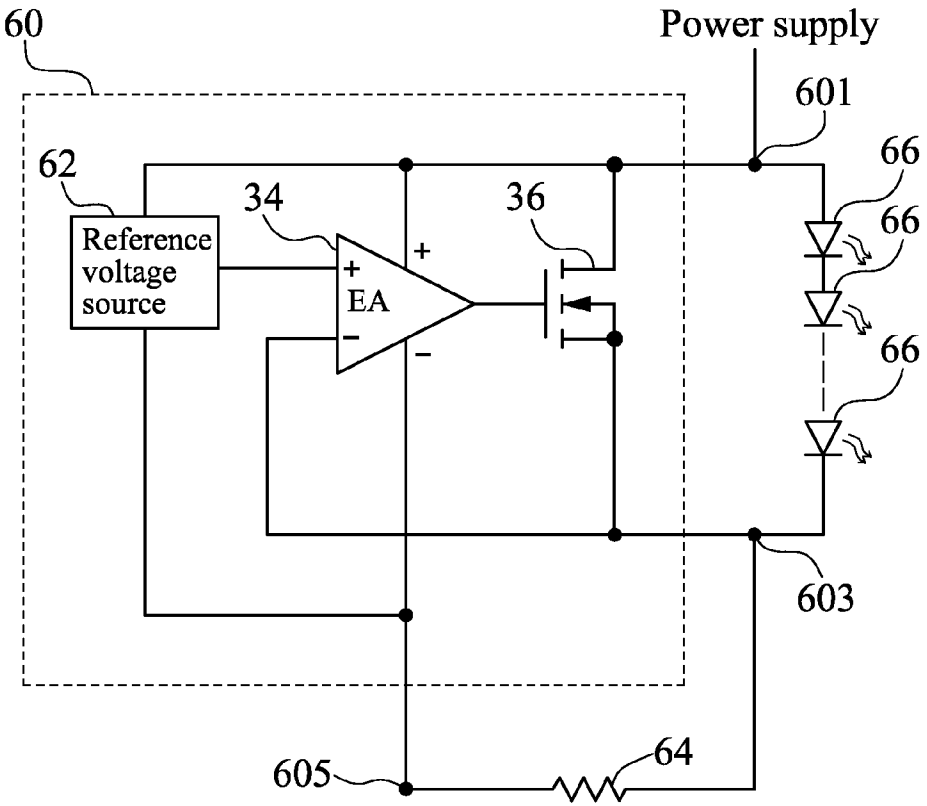
FIG. 6 shows a circuit diagram for another embodiment of the light emitting diode module.

Referring to FIG. 6, a circuit diagram for another embodiment of the light emitting diode module is shown. The structure and configuration of the light emitting diode module for this embodiment is substantially the same as the embodiment shown in FIG. 3, with one of the difference being that the light emitting diode module of present embodiment can be realized by having more than one light emitting diodes 66 serially connected in between the first terminal 601 and the second terminal 603 of the bypass circuit 60. The direct current power supply or the third terminal 605 of the adjacent upstream light emitting diode module is connected to the first terminal 601, and the third terminal 605 is connected to the first terminal 601 or the ground terminal of the adjacent downstream light emitting diode module: Because there are an abundant number of light emitting diodes 66 being serially connected between the first terminal 601 and the second terminal 603, the first terminal 601 and the second terminal 603 of the bypass circuit 60 requires corresponding changes to thereby accommodate. The voltage across the first terminal 601 and the second terminal 603 of the bypass circuit 60 can use different reference voltage sources 62, or can modify the resistance for the sensing resistor 64 to thereby achieve intended requirements.

For the sake of convenience for adjusting the amount of the voltage across the rated bypass current, the first terminal 601 and the second terminal 603, the embodiments of the present invention describe that the reference voltage source 62, the error amplifier 34, and the current limiting transistor 36 are to be integrated into one single circuit chip, and the sensing resistor 64 is externally connected between the second terminal 603 and the third terminal 605. The sensing resistor 64 can be a variable resistor, for allowing the adjustment of the resistance needed, or the sensing resistor 64 can be replaced with another resistor with a different value based upon particular usage requirements, thereby achieving desired efficiency.

Described above are only embodiments of the present invention, therefore, it is not intended to limit the scope of the present invention, as a result, the scope of any patent described in accordance with this invention of the shape, structure, characteristics, methods, and spirit of modifications of equivalent nature should be included in the scope of this invention without departing from the spirit and scope of the disclosure.

What is claimed is:

1. A driving circuit for a plurality of cascade light emitting diodes, comprising:

a power module providing a direct current voltage and a ground potential;

a plurality of light emitting diode modules serially connected between the direct current voltage and the ground potential, with each light emitting diode module comprising a bypass circuit and a light emitting diode, wherein each bypass circuit comprises a first terminal, a second terminal, and a third terminal, with each light emitting diode connecting between the first terminal and the second terminal of the bypass circuit, respectively, and wherein the first terminal of each bypass circuit is connected to the direct current or the third terminal of an adjacent upstream bypass circuit; and a constant current component serially connected between the plurality of light emitting diode modules and the power module;

wherein each bypass circuit respectively comprises:

a first terminal, a second terminal, and a third terminal;

a reference voltage source connected to the first terminal and the third terminal and producing a reference voltage;

a current limiting transistor connected between the first terminal and second terminal and adjusting a bypass current passing through, an error amplifier having a positive terminal connected to the reference voltage source, a negative terminal connected to the second terminal of the bypass circuit, and an output terminal connected to a gate or a base of the current limiting transistor; and a sensing resistor connected to the second terminal and the third terminal.

2. The driving circuit as claimed in claim 1, wherein the bypass circuit is integrated in one single circuit chip.

3. The driving circuit as claimed in claim 1, wherein the reference voltage source, the current limiting transistor, and the error amplifier of the bypass circuit are integrated into one single circuit chip, and the sensing resistor is disposed outside of the one single circuit chip.

4. The driving circuit as claimed in claim 3, wherein the sensing resistor is a variable resistor or an exchangeable variable resistor.

5. The driving circuit as claimed in claim 1, wherein the constant current component is a constant current diode.

6. The driving circuit as claimed in claim 1, wherein each light emitting diode module comprises a plurality of light emitting diodes, respectively, with the light emitting diodes serially connecting between the first terminal and the second terminal of the corresponding bypass circuit.

7. The driving circuit as claimed in claim 1, further comprising a plurality of light emitting diodes serially connecting between the the plurality of light emitting diode modules and the power module.

8. The driving circuit as claimed in claim 1, wherein the constant current component is a current limiting resistor.

* * * * *